US008359688B2

(12) United States Patent
Murphy et al.

(10) Patent No.: US 8,359,688 B2
(45) Date of Patent: Jan. 29, 2013

(54) TAMPER EVIDENT MATTRESSES, MATTRESS FOUNDATIONS, AND UPHOLSTERED FURNITURE ARTICLES

(75) Inventors: Harrison R. Murphy, Great Falls, VA (US); Juraj Michal Daniel Slavik, II, McLean, VA (US)

(73) Assignee: kickball concepts, llc, Great Falls, VA (US)

( * ) Notice: Subject to any disclaimer, the term of this patent is extended or adjusted under 35 U.S.C. 154(b) by 875 days.

(21) Appl. No.: 12/251,545

(22) Filed: Oct. 15, 2008

(65) Prior Publication Data

US 2009/0094755 A1 Apr. 16, 2009

Related U.S. Application Data

(60) Provisional application No. 60/980,283, filed on Oct. 16, 2007.

(51) Int. Cl.
*A47C 31/10* (2006.01)

(52) U.S. Cl. ..... 5/737; 5/482; 5/499

(58) Field of Classification Search ..... 5/482, 484, 5/487, 496, 497, 499–502, 737
See application file for complete search history.

(56) References Cited

U.S. PATENT DOCUMENTS 3,636,575 A * 1/1972 Smith ..... 5/499
4,862,438 A * 8/1989 Fry ..... 369/19
4,941,196 A * 7/1990 Edelman et al. ..... 383/5
5,042,099 A * 8/1991 Brenner et al. ..... 5/502
6,381,778 B1 * 5/2002 Peterson ..... 5/497
6,823,548 B2 11/2004 Murphy et al.
7,365,033 B1 4/2008 Murphy et al.
2004/0060120 A1 4/2004 Murphy et al.
2006/0135014 A1 6/2006 Murphy et al.
2007/0249248 A1 10/2007 Murphy et al.
2008/0149903 A1 6/2008 Murphy et al.

OTHER PUBLICATIONS

Hwang, Stephen W., Svoboda, Tomislav J., De Jong, Iain J., Kabasele, Karl J., and Gogosis, Evie, "Bed Bug Investations in an Urban Environment," Emerging Infectious Diseases, vol. 11, No. 4, Apr. 2005.

* cited by examiner

*Primary Examiner* — Robert G Santos
*Assistant Examiner* — Nicholas Polito
(74) *Attorney, Agent, or Firm* — Heslin Rothenberg Farley & Mesiti P.C.

(57) ABSTRACT

A mattress, mattress foundation, upholstered furniture article and/or filled furnishing article for use in residential and institutional occupancies includes outer removable cover that incorporates a mechanism to visually communicate that the outer removable cover has been opened and the internal components of the mattress, mattress foundation, upholstered furniture article or filling furnishing article has been potentially tampered with. Also disclosed are covers having resealable closing system and a tamper evident seal, and methods for providing an outer removable cover assembly for an article of furniture.

33 Claims, 4 Drawing Sheets

TAMPER EVIDENT MATTRESSES, MATTRESS FOUNDATIONS, AND UPHOLSTERED FURNITURE ARTICLES

CLAIM TO PRIORITY

This application claims the benefit of U.S. Provisional Application No. 60/980,283, filed Oct. 16, 2007, entitled "Tamper Evident Mattresses, Mattress Foundations, And Upholstered Furniture Articles", which application is hereby incorporated in its entirety herein by reference.

FIELD OF THE INVENTION

This invention relates generally to filled furnishing articles, and more particularly to mattresses, mattress foundations, upholstered furniture articles and filled furnishing articles having tamper evident covers.

BACKGROUND OF THE INVENTION

According to the International Sleep Products Association (ISPA) the domestic U.S. mattress industry shipped mattresses and foundation units in 2006 totaling 43 million pieces or roughly 20 million sets of bedding with an estimated retail value in excess of $12 billion. Non-residential or contract sales account for more than 2½ million units sold to lodging, healthcare, dormitories, etc.

According to Furniture Today, the domestic U.S. retail sales of furniture in 2006 totaled approximately $63.9 billion.

Mattresses, mattress foundations, upholstered furniture articles or filled furnishing articles have traditionally been fashioned so as to cause the cover materials to be permanently attached to the composite article, with no or limited opportunity for individuals to access the internal components of the article. Attempts have been made using user-installable, replaceable outer covers.

There is a need for further mattresses, mattress foundations, upholstered furniture articles and filled furnishing articles having tamper evident covers.

SUMMARY OF THE INVENTION

The present invention, in a first aspect, is directed to at least one of a mattress and a mattress foundation which includes an inner resilient support system, an outer removable cover disposable around the resilient inner support system, a resealable closing system allowing the inner resilient inner support system to be received in the outer removable outer cover, and a tamper evident seal for covering at least a portion of the resealable closing system to inhibit opening of the resealable closing system and accessing the inner resilient inner support system and upon tampering of the tamper evident seal indicating that access to the resealable closing system and to the inner resilient support systems has been compromised.

The present invention, in a second aspect, is directed to such a mattress and mattress foundation set as described above.

The present invention, in a third aspect, is directed to an article of furniture which includes an inner resilient support system, an outer removable cover disposable around the resilient inner support system, a resealable closing system allowing the inner resilient support system to be received in the outer removable cover, and a tamper evident seal for covering at least a portion of the resealable closing system to inhibit opening of the resealable closing system and accessing the resilient inner support system and upon tampering of the tamper evident seal indicating that access to the resealable closing system and to the inner resilient support systems has been compromised.

The present invention, in a fourth aspect, is directed to a cover assembly for an article of furniture having a resilient inner support system. The cover assembly includes an outer removable cover disposable around the resilient inner support system, a resealable closing system allowing the inner resilient support system to be received in the removable outer cover, and a tamper evident seal for covering at least a portion of the resealable closing system to inhibit opening of the resealable closing system and accessing the resilient inner support system and upon tampering of the tamper evident seal indicating access to the resealable closing system and to the inner resilient support systems has been compromised.

The present invention, in a fifth aspect, is directed to a method for providing a removable outer cover assembly for an article of furniture. The method includes covering an inner resilient support system of the article of furniture with an outer removable cover having a resealable closing system, and securing a tamper evident seal covering at least a portion of the resealable closing system to inhibit opening of the resealable closing system and accessing the inner resilient support system and upon tampering of the tamper evident seal indicating access to the resealable closing system and to the inner resilient support systems has been compromised.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

Figure 1:
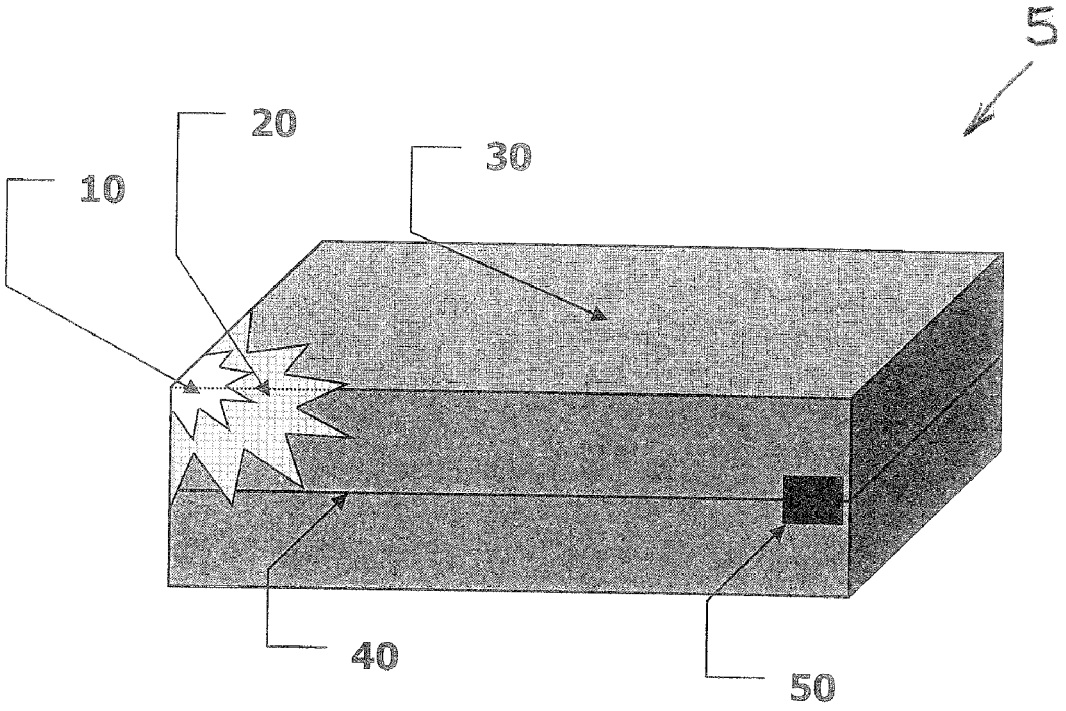
FIG. 1 is a perspective view of a mattress featuring a removable cover protected by the tamper evident seal in accordance with the present invention.

The present invention, in one aspect, relates to a composite item, such as a mattress, mattress foundation, upholstered furniture article or other filled furnishing article made available to consumers or institutional/industrial buyers and said composite item has as its outermost cover, a removable cover that features a closing system made from a zipper or zipper-like assembly and a tamper evident or tamper proof seal.

In one aspect of the invention, the present invention provides an improved mattress, mattress foundation, upholstered furniture article and/or other article filled with resilient cushioning materials that:

a. Has a user-installable, replaceable outer cover, which:

b. Includes zipper or closing system that provides for a closing or slide mechanism that locks or at a minimum restricts or inhibits free or inadvertent movement of the slide, and c. The terminating point of the slide assembly, at the point at which the zipper or closure system is fully and completely installed about the mattress, mattress foundation, upholstered furniture article or other article filled with resilient cushioning materials, is covered by a flap of fabric (e.g., integrally created as part of the outer cover itself or other material that is permanently affixed to the cover and both blocks access to the slide mechanism and depicts sufficient visual evidence to tampering when the slide mechanism has been accessed in an unauthorized manner.

d. The tamper evident design provides the purchasing party or its authorized representative to visually inspect a consistent point of the composite article and reasonably ascertain whether or not the cover assembly has been breached in an unauthorized manner.

e. The tamper evident design may provide manufacturers, resellers or distributors of mattresses, mattress foundations, upholstered furniture articles and other filled furnishings with the mechanism by which to validate or invalidate warranty claims and substantiate or disavow product liability on the basis of unauthorized access to the internal components of such finished articles.

f. The tamper evident design may provide manufacturers, resellers, distributors or owners of mattresses, mattress foundations, upholstered furniture articles or other filled furnishings with a means to have multiple replaceable or removable covers installed on an originally manufactured composite article and then provide for the orderly and authorized removal of just the outermost layer as dictated by wear or damage.

One facet of the method offered by the present invention relates to its use in simplifying the communication of complex performance attributes of mattresses and mattress sets to consumers. In the context of the present invention, terms relating to mattresses are defined in conformity with terms as defined by 16 C.F.R. 1632, and as follows:

(a) Mattress means a ticking filled with a resilient material used alone or in combination with other products intended or promoted for sleeping upon.

(1) This definition includes, but is not limited to, adult mattresses, youth mattresses, crib mattresses including portable crib mattresses, bunk bed mattresses, futons, water beds and air mattresses which contain upholstery material between the ticking and the mattress core, and any detachable mattresses used in any item of upholstered furniture such as convertible sofa bed mattresses, corner group mattresses, day bed mattresses, roll-a-way bed mattresses, high risers, and trundle bed mattresses. See Sec. 1632.8 Glossary of terms, for definitions of these items.

(2) This definition excludes sleeping bags, pillows, mattress foundations, liquid and gaseous filled tickings such as water beds and air mattresses which do not contain upholstery material between the ticking and the mattress core, upholstered furniture which does not contain a detachable mattress such as chaise lounges, drop-arm love seats, press-back lounges, push-back sofas, sleep lounges, sofa beds (including jackknife sofa beds), sofa lounges (including glide-outs), studio couches and studio divans (including twin studio divans and studio beds), and juvenile product pads such as car bed pads, carriage pads, basket pads, infant carrier and lounge pads, dressing table pads, stroller pads, crib bumpers, and playpen pads. See Sec. 1632.8 Glossary of terms, for definitions of these items.

(b) Mattress Pad means a thin, flat mat or cushion, and/or ticking filled with resilient material for use on top of a mattress. This definition includes, but is not limited to, absorbent mattress pads, flat decubitus pads, and convoluted foam pads which are totally enclosed in ticking. This definition excludes convoluted foam pads which are not totally encased in ticking.

(c) Ticking means the outermost layer of fabric or related material that encloses the core and upholstery materials of a mattress or mattress pad. A mattress ticking may consist of several layers of fabric or related materials quilted together.

(d) Core means the main support system that may be present in a mattress, such as springs, foam, hair block, water bladder, air bladder, or resilient filling.

(e) Upholstery material means all material, either loose or attached, between the mattress or mattress pad ticking and the core of a mattress, if a core is present.

(f) Tape edge (edge) means the seam or border edge of a mattress or mattress pad.

(g) Quilted means stitched with thread or by fusion through the ticking and one or more layers of upholstery material.

(h) Tufted means buttoned or laced through the ticking and upholstery material and/or core, or having the ticking and upholstery material and/or core drawn together at intervals by any other method which produces a series of depressions on the surface." (16CFR1632.2).

. . .

(r) Mattress foundation. Consists of any surface such as foam, box springs or other, upon which a mattress is placed to lend it support for use in sleeping upon." (16CFR1632.8)

Additionally, in the context of the present invention, these terms are further defined in conformity with terms as defined by the Consumer Product Safety Commission, 16 CFR Part 1633, Standard for the Flammability (Open Flame) of Mattress Sets; Final Rule—published in the Federal Register, Mar. 15, 2006.

Another aspect of the present invention relates to its use in articles of upholstered furniture. In the context of the present invention, terms relating to upholstered furniture are defined in conformity with terms as defined by the draft language of 16 C.F.R. 1634, as published by the CPSC in May 2005, and incorporated in their entirety herein by reference.

Still another aspect of the present invention relates to its use in other articles filled with resilient cushioning materials. In the context of the present invention, terms relating to filled articles and bedding are defined as follows in conformity with the terms defined by the California BHFTI draft of Technical Bulletin #604 published Oct. 1, 2004, and the ANPR for 16 CFR 1634 Standard To Address Open Flame Ignition of Bedclothes published by the CPSC in the Federal Register on Jan. 13, 2005, pages 2514 through 2517, and incorporated in their entirety herein by reference.

Specific design parameters of the mattress, mattress foundation, upholstered furniture article or other article filled with resilient cushioning materials are not intended to limit the scope of the present invention.

Twin Sized Mattress

FIG. 1 shows a twin sized mattress 5 measuring 39 inches wide by 75 inches long by 6 inches thick. The mattress may include an inner resilient support system such as a solid core of poured polyurethane foam. It will be appreciated that other resilient support systems may be employed, e.g., springs, etc.

The foam core 10 may be encapsulated in a sleeve of tubular knitted fire barrier sleeve or fabric 20 comprised of fiberglass, modacrylic and polyester sold under the brand Integrity30®, manufactured and sold by Ventex, Inc. of Great Falls, Va. since 1993. Alternative embodiments of the knitted fire barrier may be comprised of fiberglass, flame-retardant TCF rayon fiber, and polyester.

The tubular knitted fire barrier sleeve 20 may be closed at each end of the foam core by gluing and overlapping the barrier at the head and foot of the mattress core. An alternative approach to closing the tubular fire barrier sleeve includes sewing the ends closed using a para-aramid thread such as SpunGold® Tex 50 sewing thread available from Ventex, Inc. of Great Falls, Va. since 1998.

An outer removable cover 30 for the mattress may include two SOFlux OX® Mattress Ticking, a 200-210 denier oxford weave nylon fabric with a waterproof polyurethane coating. The top half and the bottom half of the cover may be joined with a resealable closing system 40, e.g., a zipper that transited the full lateral circumference of the mattress dimension. The zipper used featured a hidden profile and an automatic or locking slide with removable pull tab manufactured by YKK. The zipper slide may be key locking.

The cover assembly is zipped together and encapsulates the foam mattress core that has previously been encapsulated in the tubular fire barrier fabric sleeve.

The tamper evident seal 50 of the present invention may be made of TYVEK® material and installed at the termination point of the zipper, e.g., at the point the point at which the zipper slider comes to rest once the zipper assembly is fully closed during installation of the cover.

TYVEK® is formed by a fully integrated process using continuous and very fine fibers of 100-percent high-density polyethylene or polyolefin that are randomly distributed and non-directional. These fibers are first flash spun, then laid as a web on a moving bed before being bonded together by heat and pressure—without the use of binders, sizers or fillers. The tamper evident label made from TYVEK® may be printed with suitable indicia to identify it as a tamper evident item. From the above description, it is appreciated that other suitable materials may be use for providing a tamper evident seal in accordance with the present invention. For example, the tamper evident seal may be may comprise Typar, urethane film, olefin film, vinyl film, films supported with fabric scrims, or other such material possessing high tensile or tear strength. In addition, the tamper evident seal may be a fabric material, and as described below, may be formed and integral with the outer removable cover.

Figure 2:
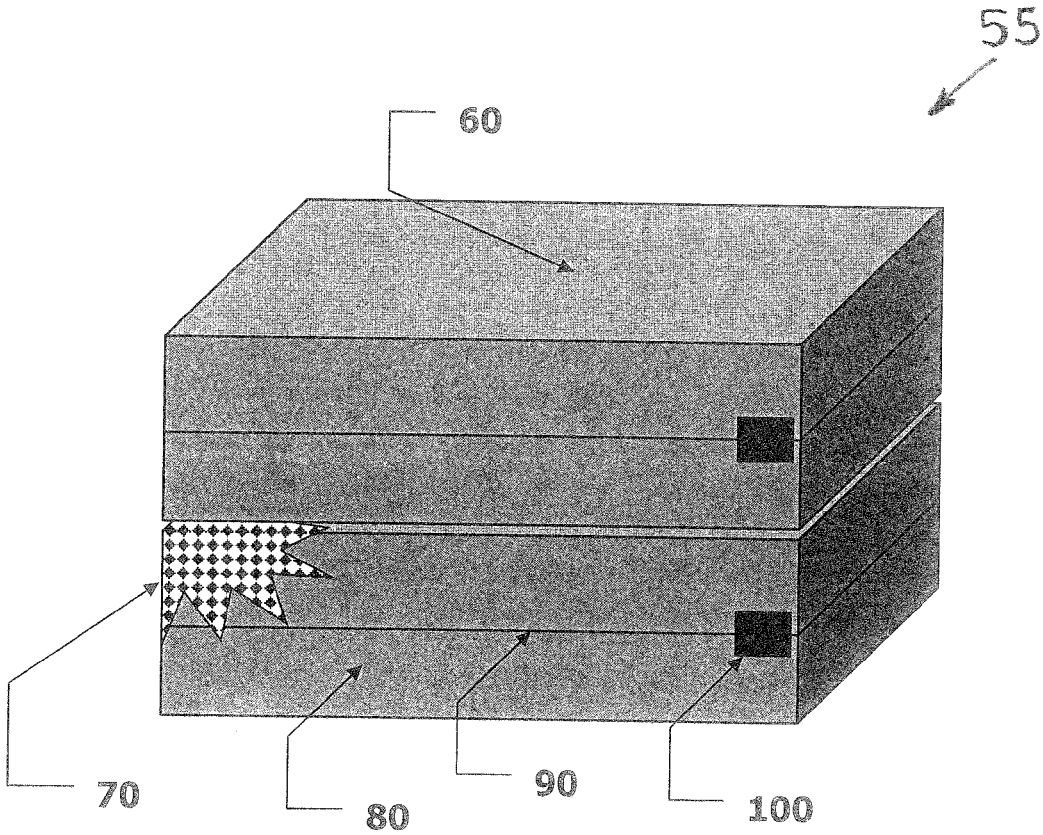
FIG. 2 is a perspective view of a mattress and its matching foundation featuring a removable covers protected by the tamper evident seal in accordance with the present invention.

FIG. 2 shows a set 55 of bedding consisting of a twin sized mattress 60 measuring 39 inches wide by 75 inches long by 6 inches thick fabricated as described in reference to FIG. 1 above and a matching foundation ("box-spring") 70 prepared as described below. For example, the box spring unit 70 may be a premanufactured SEMI-FOLD™ box spring unit (foundation) measuring 39 inches wide by 75 inches long by 9 inches thick and available from Leggett & Platt.

A removable outer cover 80 for the foundation may include two pieces of SOFlux OX® Mattress Ticking, a 200-210 denier oxford weave nylon fabric with a waterproof polyurethane coating. The top half and the bottom half of the cover were joined with a resealable closing system 90, e.g., a zipper that transited the full lateral circumference of the foundation dimension. The zipper used featured a hidden profile and an automatic or locking slide with removable pull tab manufactured by YKK. The zipper slide may be key locking. The cover assembly is zipped together and encapsulates the premanufactured foundation. The tamper evident seal 100 of the present invention made of TYVEK® is installed at the termination point of the zipper, e.g., the point at which the zipper slider comes to rest once the zipper assembly is fully closed during installation of the cover.

If the flammability performance of the foundation assembly were determined to be in need of improvement, an alternative embodiment of the foundation assembly may include the foundation encapsulated in a sleeve of tubular knitted fire barrier fabric comprised of fiberglass, modacrylic and polyester sold under the brand Integrity30®, manufactured and sold by Ventex, Inc. of Great Falls, Va. since 1993. Alternative embodiments of the knitted fire barrier may be comprised of fiberglass, flame-retardant TCF rayon fiber, and polyester.

The tubular knitted fire barrier sleeve may be closed at each end of the foundation assembly by gluing and overlapping the barrier at the head and foot of the mattress core. An alternative approach to closing the tubular fire barrier sleeve may include sewing the ends closed using a para-aramid thread such as SpunGold® Tex 50 sewing thread available from Ventex, Inc. of Great Falls, Va. since 1998. The removable outer cover for the mattress may then be installed over the fire barrier encased foundation assembly as previously recited and depicted.

Figure 3:
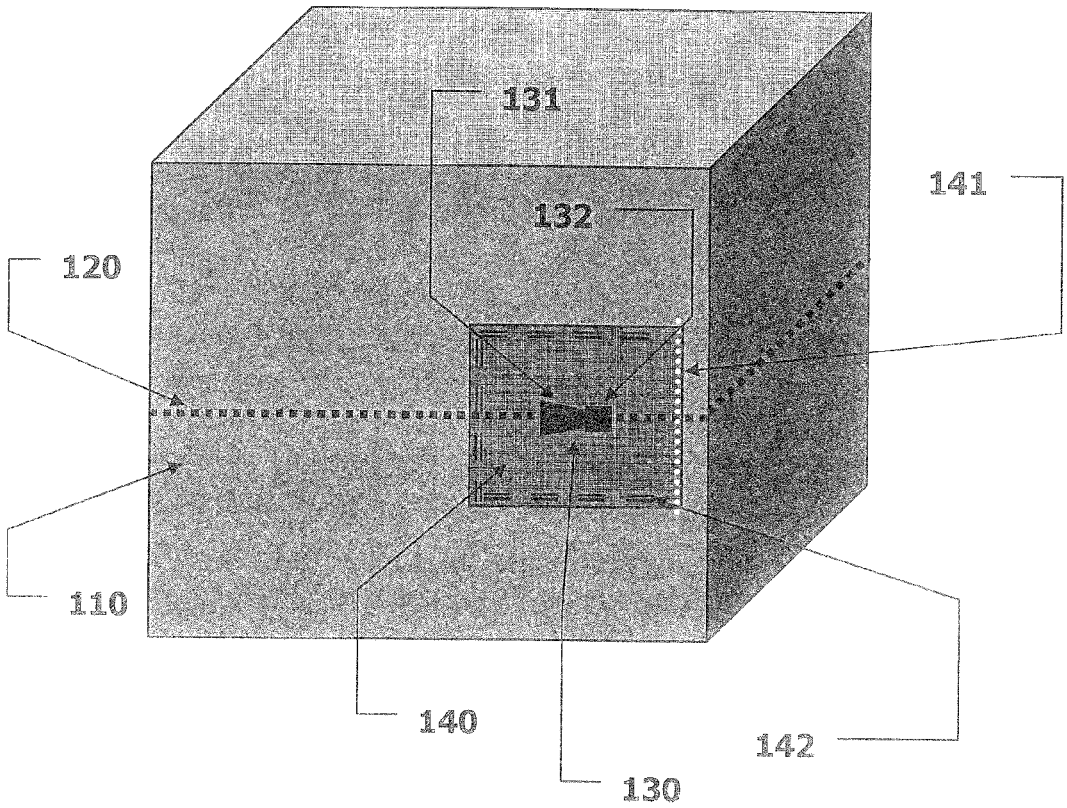
FIG. 3 is an enlarged view of the tamper evident seal in accordance with the present invention.

FIG. 3 shows an enlarged view of the tamper evident seal of the present invention employed, e.g., in the embodiments shown in FIGS. 1 and 2. The cover fabric 110 may be joined together by a zipper 120 that transits either entirely or partially the lateral circumference of the covered article. The zipper slide 130 comes to rest at its termination point, e.g., the point at which the zipper slider comes to rest once the zipper assembly is fully closed during installation of the cover, and is covered by the tamper evident seal 140 of the present invention. The zipper slide assembly may be left intact or alternatively the pull-tab 131 of the zipper may be removed from the body and crown assembly 132 of the zipper. The tamper evident seal 140 may comprise a high strength fabric and may be attached by a sewn seam 141 on one edge and then adhered in place with a line of adhesive 142 applied to the remaining three sides of the seal that come in contact with the cover surface. Alternative methods of adhering the seal to the cover are contemplated, such as sewing on more than one side and adhering on less than three sides. For example, the tamper evident seal may be joined to the outer removable cover of a mattress or mattress foundation using sewn seams, permanent adhesives, semi-permanent and destructive adhesives, heat sealed welds, sonically welded seams, or radio frequency welds. The tamper evident seal may be adhered to the removable outer cover of a mattress or mattress foundation using epoxy, acrylic, or urethane based adhesives, anaerobic adhesives, hot melt adhesive systems, Polyurethane Reactive (PUR) adhesive systems, fast-setting water-based contact adhesives, or aerosol adhesives. Another alternative embodiment of the seal may include a frangible material that is permanently adhered to the cover, and thus, causes the seal to disintegrate when altered, tampered with or removed.

In addition, it is possible to include a message or other indicia that becomes visible in the seal system when tampering has occurred. For example, the indicia may be printed on the outer covering and if the seal material is removed the message or indicia may then be exposed. The indicia may be printed on the seal or the outer covering and may include the words "VOID IF SEAL IS BROKEN" OR "VOID IF SEAL IS DAMAGED"

In another embodiment, the resealable closing system may include a hook-and-loop closing system structured and disposed to allow the outer removable cover to be disposed around the resilient inner support system. The tamper evident seal may be disposed over a portion or the entire hook-and-loop closing system. Suitable hook-and-loop closing systems may employ VELCRO hook-and-loop fasteners.

Figure 4:
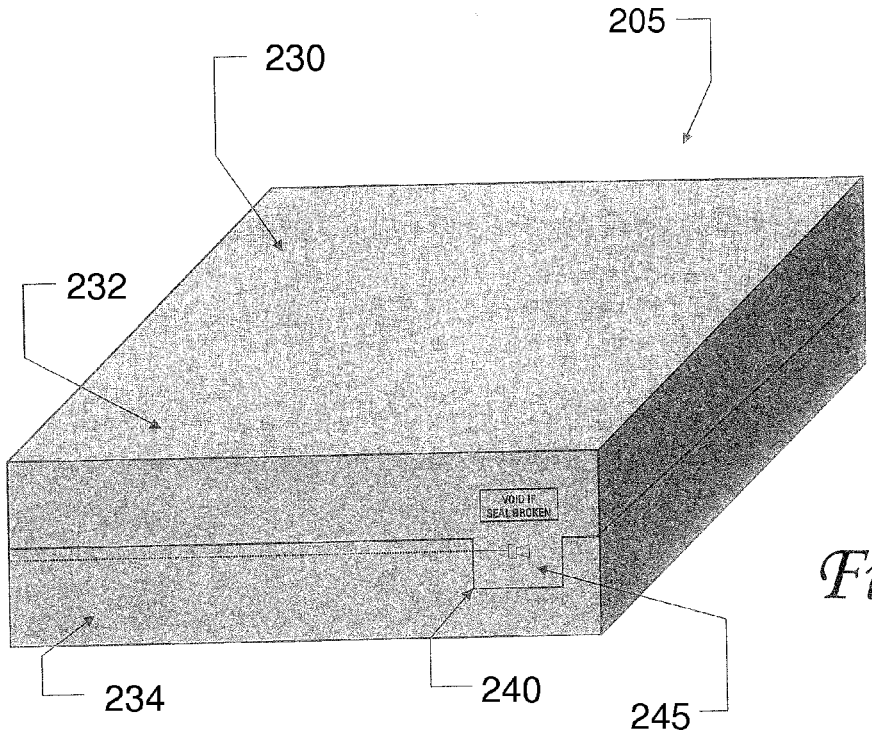
FIG. 4 is perspective view of a portion of another embodiment of a mattress featuring a removable cover protected by a tamper evident seal in accordance with the present invention.

FIG. 4 illustrates another embodiment of the present invention for a mattress or mattress foundation 205 having a tamper evident seal 240 in accordance with the present invention. In this embodiment, tamper evident seal 240 may be integrally formed as part of the outer removable cover itself. For example, outer removable cover 230 may be formed form one or more pieces of material or fabric 232 and 234, and the tamper evident seal may be a flap 245 that is formed from and integral with the outer removable covering. Flap 245 may be sewn or adhesively bonded over the slide of the zipper. It will be appreciated that other means for securing the tamper evident seal to inhibit opening of said resealable closing system and accessing said inner resilient support system and indicating that access to said resealable closing system and to the inner resilient support system has been compromised may be suitably employed.

Figure 5:
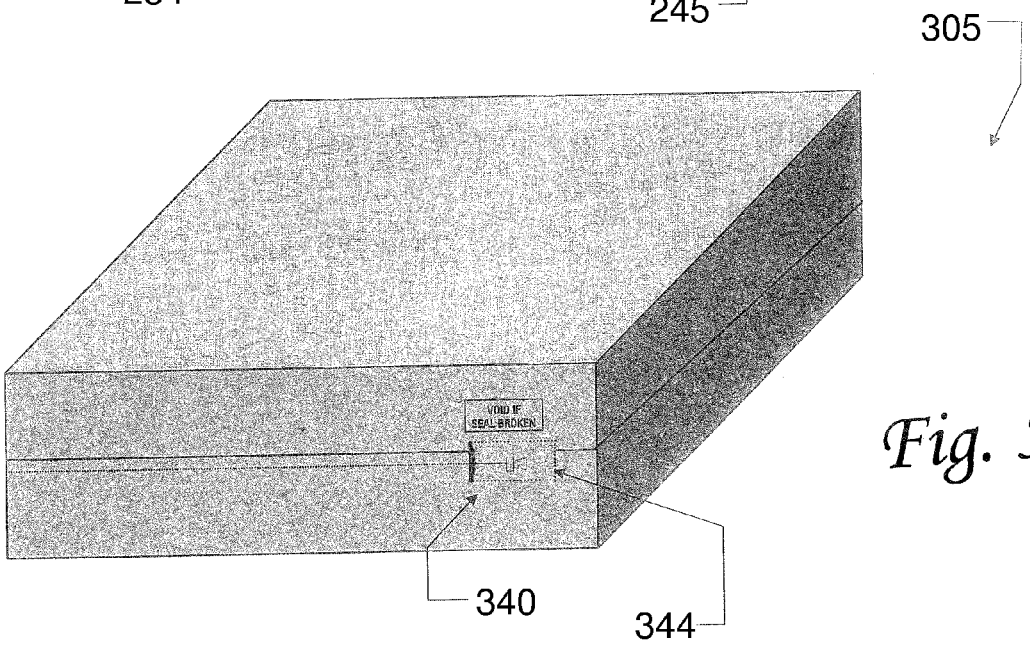
FIG. 5 is perspective view of another embodiment of a portion of a mattress featuring a removable cover protected by a tamper evident seal in accordance with the present invention.

FIG. 5 illustrates another embodiment of the present invention for a mattress or mattress foundation 305 having a tamper evident seal 340 in accordance with the present invention. In this embodiment, tamper evident seal 340 may be integrally formed as part of the outer removable cover itself. For example, the tamper evident seal may be formed into a pocket 344 for providing a place that the zipper slide can be pushed into and covered. An adhesive material (e.g. silicone adhesive) may be deposited into the pocket to effectively seal the zipper slide in the pocket to creating the situation that if someone opened the sealed pocket there would be evidence of tampering. It will be appreciated that other means for securing the tamper evident seal in the pocket to inhibit opening of said resealable closing system and accessing said inner resilient support system and indicating that access to said resealable closing system and to the inner resilient support system has been compromised may be suitably employed.

Testing

Objective testing of the tamper evident sealing system may include measuring the adhesive strength by which the seal is bonded to the cover material. Additionally, the tear strength of the material used to make the tamper evident seal may also be a basis of evaluation of the quality of the sealing system.

Whereas mattresses, mattress foundations, upholstered furniture articles and/or filled furnishing articles have traditionally been fashioned so as to cause the cover materials to permanently attached to the composite article, with no or limited opportunity for individuals to access the internal components of the article, the present invention provides several benefits over user-installable, replaceable outer covers.

For example, a potential adverse consequence of a user-installable, replaceable outer covers is that the internal components now, because of regulations like 16 CFR 1633 and NFPA 101®, include critical life safety components such as fire barriers and tampering with or compromising the performance of the barrier due to potential direct access to the barrier, may have adverse life safety implications.

Another potential adverse consequence may be an increased incidence of hiding contraband inside the cover. This contraband could take the form or drugs or weapons. Additionally, material might be secreted inside the user accessible cover, such as food, hygiene materials, or waste materials, all of which could cause rot or decay inside the mattress, so as to put the asset value at risk.

It has been unexpectedly realized that the value of a user-installable, replaceable outer cover for a mattress, mattress foundation, upholstered furniture article and/or other article filled with resilient cushioning materials may be fully realized if that article and its cover incorporates aspects of the present invention that provide the ability to reveal tampering or opening of the cover by parties not intended or permitted to do so.

In addition, the present invention may also impact on redesign of mattress manufacturing approaches in the desire to have replaceable covers, particularly with tamper evident covers. For example, replaceable covers offer a myriad of benefits to end users and institutional buyers, from reducing the costs associated with bed bug infestations, to promoting sanitary maintenance and appearance of the items, to allowing users to rejuvenate their property without compromising performance attributes.

There has been a recent relative explosion in the number of reported cases of bed bug infestations and personal injuries caused by bed bugs in hotels and dormitories throughout the U.S. After years of comparable dormancy, these increased infestations are being attributed to evolution by the pests away from available pesticide treatments and the increasing restrictions placed due to potential health hazards. The remediation of such infestations is costly and has historically called for both extermination of the infestation by use of pesticide agents and the disposal of all infested articles of furnishings, e.g., most typically the mattress and mattress foundation.

The mattress and mattress foundation are particularly susceptible to bed bug infestations, as well as infestations of other parasites, including pubic lice or "crabs" (*Phthiriasis*) and scabies (*Sarcoptes scabei*). Bed bugs, which are larger than pubic lice and scabies, have been found to live in the area in traditional mattress design called the tape edge. This is the sewn seam used to join the mattress panel assembly (the horizontal sleep surface or bottom) to the mattress border assembly (the vertical side). The tape edge construction creates cracks and crevices in which the bed bugs live and reproduce and which places them in close proximity to their warm blooded prey, e.g., sleeping humans.

These infestations can also affect upholstered furniture and filled furnishing articles.

The cost to multi-user occupancies, such as hotels and dormitories, of replacing dozens or even hundreds of mattresses, mattress foundations, upholstered furniture articles and/or filled furnishing articles as the result of an infestation can be high. The relative cost to individual consumers of a smaller scale replacement in their home may also be high. Because of the high cost, both large scale facilities and consumers may choose to avoid the disposal of traditionally designed articles and put themselves at risk for further damage as they may not have successfully eradicated the problem.

The benefit of being able to reduce some or all of the potential expense through simply being able to remove an infested outer cover and replace that cover over the uninfested internal core structure can deliver potentially substantial economic savings to the victim of an infestation, while also deriving the desired outcome of complete eradication of the infestation.

In healthcare occupancies, the incidence of damage to the exterior fabrics of furnishings and mattresses by biohazard contamination, staining and soiling is commonplace. Healthcare mattresses (also known as therapeutic support surfaces) and other furnishings found in healthcare occupancies must often incorporate greater degrees of performance features than similar items found in other environments. Elements, such as antibacterial treatments, fluid proofness, additional flame retardant finishes needed to meet higher level fire standards not required in residential environments, and sophisticated cushioning systems and filling materials engineered to prevent skin shear and decubitus ulcers and to promote pressure reduction in the treatment of complex medical issues all combine to create composite articles requiring substantially greater economic investment than their residential counterparts. Forced disposal of the entire units when permanently installed covers are part of the design just does not make sense and thus removable, replaceable covers are preferred.

In healthcare occupancies, there are varied commercial approaches and relationships used to deliver mattresses and furnishing articles to healthcare occupancies. One approach is for facilities to purchase such items outright from suppliers. Another is for durable medical equipment (DME) dealers to purchase the units and then rent or lease them to end-users (either facilities or even individual in-home users), the rental payments being covered by Medicare/Medicaid or other insurance reimbursements. In both cases, the need to be able to replace covers on healthcare composite items offers the preferred economic benefit to disposal of the entire asset by the end-users.

One additional consideration in healthcare occupancies has to do with preserving the performance attributes designed into certain support surfaces. On sophisticated pressure reduction support surfaces, the selection of filling materials, fire barriers and cover fabrics is carefully coordinated to promote interface pressure levels that are not harmful to bedridden patients and may even offer therapeutic value. A soiled unit of this design with a permanently installed cover would be an expensive asset to dispose of if only the cover required replacing. Adding an additional cover fabric over top of a permanently installed cover could diminish the performance profile. The preferred solution is removal of a non-permanent cover and replacement with a new cover of identical design.

It is possible that in certain circumstances and applications, where the pressure reduction or other performance attributes created by the interrelationship of the cover and filling materials are not as sensitive to alteration or modification, that it may be desirable for a manufacturer to install multiple replaceable covers, layered one over the top of another, so that as damage occurs to the outermost layer, it may be removed and the remaining intact cover layers still provide for a usable composite article.

A previously unforeseen benefit that may be derived from the installation of multiple layered replaceable covers over a mattress core may be observed in a reduction of skin shear forces or frictional abrasion on immobile patients at risk for bed sores.

These types of considerations would also be applicable in the home or at the residential level.

Providing purchasers of such composite articles contemplated by the present invention with the ability to replace only the outermost cover of composite articles may realize cost savings as an alternative to disposing traditionally designed such composite article to which the outermost cover assembly is permanently attached and not therefore replaceable at the installation level, e.g. at the hotel, hospital or dormitory itself.

The present invention may also be combined with the incorporation of fire barrier materials into the internal structure of mattresses and mattress foundations as a result of new fire safety standards and the increasing likelihood of such mandated requirements being applied to upholstered furniture articles and other filled home furnishing articles such as pillows, quilts, comforters, mattress pads and bed linens.

The implementation of the Federal Standard for the Flammability (Open Flame) of Mattress Sets; Final Rule 16 CFR 1633 has mandated that all mattresses sold in the United States meet an open flame, full-scale fire test.

Incorporating fire barrier fabrics into the internal structure of mattresses and mattress foundations has also been caused by the increased adoption of the NFPA 101® Life Safety Code by the Federal government (Centers for Medicare and Medicaid), states (more than 40), localities, and private accreditation bodies (Joint Commission on Accreditation of Healthcare Occupancies—JCAHO). NFPA 101 call for introduction of new mattresses and upholstered furniture into high risk occupancies (e.g. hospitals, detention facilities, dormitories, etc) that meet restricted rates of heat release when exposed to open flame ignition.

The need to incorporate fire barrier fabrics into the internal structure of upholstered furniture articles and other filled furnishings items will also increase with the activity in the areas of mandating open flame resistance in furniture and bedding through efforts such as the draft language of 16 C.F.R. 1634, as published by the CPSC in May 2005, and incorporated in their entirety herein by reference, the California BHFTI draft of Technical Bulletin #604 published Oct. 1, 2004, and the ANPR for 16 CFR 1634 Standard To Address Open Flame Ignition of Bedclothes published by the CPSC in the Federal Register on Jan. 13, 2005, pages 2514 through 2517, both of which are also incorporated in their entirety herein by reference.

Compliance with full scale, open-flame ignition test performance requirements is typically achieved by mattress and furniture manufacturers by installing a fire barrier material, e.g., a fabric or batting, directly beneath the outermost covering materials used to make the mattress or article of upholstered furniture.

The composition of the barriers varies widely across a diverse manufacturing base of material suppliers. In some instances, materials selected for fire barrier design are inherently, flame retardant materials that are physically stable and pose no or low risk to users of material degradation and migration of particulate matter or chemical traces away from the barrier structure. Alternatively, however, some material suppliers have chosen less-expensive and potentially less durable solutions, such as topically applying chemical solutions such a boric acid powder to staple fibers or finished fabric barrier offerings. Such approaches may not offer the physical stability and resistance to degradation offered by more expensive solutions.

When subjected to the physical impacts commonly seen in furniture and bedding applications, the risk is potentially created that may cause particulate matter shed from topically, chemically treated fire barrier solutions to be made airborne and be caused to be moved away from the barrier and potentially introduced into the respiratory and digestive processes of individuals intimate with the furnishing and bedding articles.

The above examples serve to elucidate possible embodiments of the present invention. It will be evident to one skilled in the art that the scope of the invention is not limited to the above stated examples, but can extended to include a variety of home furnishings in a variety of dimensions and configurations. Additionally, the dimensions, and number of constituting materials do not serve to limit the invention in any way, as will be apparent to one skilled in the art.

Thus, while various embodiments of the present invention have been illustrated and described, it will be appreciated to those skilled in the art that many changes and modifications may be made thereunto without departing from the spirit and scope of the invention.

The invention claimed is:

1. A mattress or a mattress foundation comprising:

an inner resilient support system;

an outer removable cover disposable around said resilient inner support system;

a resealable closing system allowing said inner resilient support system to be received in said outer removable cover, said outer removable cover and said resealable closing system operable to inhibit access to said inner resilient support system when said resealable closing system is closed; and a tamper evident seal providing a non-reusable seal for covering at least a portion of said resealable closing system to inhibit opening of said resealable closing system and accessing said inner resilient support system and upon initial tampering of said tamper evident seal maintaining a visual indication that access to said resealable closing system has been compromised; and wherein said tamper evident seal comprises a planar member comprising a frangible material which upon tampering breaks up into fragments.

2. The mattress or mattress foundation of claim 1 wherein said resealable closing system comprises a zipper structured and disposed to allow said resilient inner support system to be received in said removable outer cover.

3. The mattress or mattress foundation of claim 2 wherein said tamper evident seal is sealed over a slide of said zipper wherein said zipper in a fully closed configuration to inhibit access to said slide for opening said zipper.

4. The mattress or mattress foundation of claim 1 wherein said tamper evident seal is disposed over at least a portion of said resealable closing system.

5. The mattress or mattress foundation of claim 4 further comprising a bonding material for attaching said planar member to said resealable closing system.

6. The mattress or mattress foundation of claim 4 wherein at least one of the edges of said planar member is sewn to said resealable closing system.

7. The mattress or mattress foundation of claim 4 wherein said planar member comprises indicia indicating that the planar member is a tamper evident seal.

8. The mattress or mattress foundation of claim 4 wherein said outer removable cover comprises indicia indicating tampering which is disposed under said planar member.

9. The mattress or mattress foundation of claim 4 wherein said planar member comprises a material which is difficult to tear but easily cut with a sharp object.

10. The mattress or mattress foundation of claim 1 wherein said resealable closing system comprises a hook-and-loop closing system structured and disposed to allow said inner resilient support system to be received in said outer removable cover, and said tamper evident seal is disposed over said hook-and-loop closing system to inhibit access to said hook-and-loop closing system.

11. The mattress or mattress foundation of claim 1 wherein said tamper evident seal is formed from said outer removable cover.

12. The mattress or mattress foundation of claim 1 wherein said outer removable cover is operable to at least one of block fluid transmission, manage moisture vapor transmission, filter small particulate matter, and block small particulate matter.

13. The mattress or mattress foundation of claim 1 further comprising a plurality of outer removable covers to which is attached to a plurality of resealable closing systems and a plurality of tamper evident seals.

14. The mattress or mattress foundation of claim 1 wherein said tamper evident comprises a first appearance, and after initial tampering of said tamper evident seal, said tamper evident seal comprises a second appearance different from said first appearance.

15. A mattress and mattress foundation set comprising:

a mattress of claim 1, and a mattress foundation.

16. A mattress and mattress foundation set comprising:

a mattress, and a mattress foundation of claim 1.

17. The mattress and mattress foundation set of claim 16 wherein said mattress comprises a mattress of claim 1.

18. An article of furniture comprising:

an inner resilient support system;

an outer removable cover disposable around said resilient inner support system;

a resealable closing system allowing said a resilient inner support system to be received in said outer removable cover, said outer removable cover and said resealable closing system operable to inhibit access to said inner resilient support system when said resealable closing system is closed; and a tamper evident seal providing a non-reusable seal for covering at least a portion of said resealable closing system to inhibit opening of said resealable closing system and accessing said inner resilient support system and upon initial tampering of said tamper evident seal maintaining a visual indication that access to said resealable closing system has been compromised; and wherein said tamper evident seal comprises a planar member comprising a frangible material which upon tampering breaks up into fragments.

19. The article of furniture of claim 18 wherein said resealable closing system comprises a zipper structured and disposed to allow said inner resilient support system to be received in said outer removable cover.

20. The article of furniture of claim 19 wherein said tamper evident seal comprise a planar member sealed over a slide of said zipper in a fully closed configuration to inhibit access to said slide for opening said zipper.

21. The article of furniture of claim 20 wherein said outer removable cover comprises indicia indicating tampering which is disposed under said planar member.

22. The article of furniture of claim 19 wherein said planar member comprises indicia indicating that the planar member is a tamper evident seal.

23. The article of furniture of claim 18 wherein said resealable closing system comprises a hook-and-loop closing system structured and disposed to allow said inner resilient support system to be received in said outer removable cover, and said tamper evident seal is disposed over said hook-and-loop closing system to inhibit access to said hook-and-loop closing system.

24. The article of furniture of claim 18 wherein said tamper evident seal is formed from said outer removable cover.

25. The article of furniture of claim 18 wherein said removable outer cover is operable to at least one of block fluid transmission, manage moisture vapor transmission, filter small particulate matter, and block small particulate matter.

26. The article of furniture of claim 18 further comprising a plurality of outer removable covers to which is attached to a plurality of resealable closing systems and a plurality of tamper evident seals.

27. The article of furniture of claim 18 wherein said tamper evident comprises a first appearance, and after initial tampering of said tamper evident seal, said tamper evident seal comprises a second appearance different from said first appearance.

28. A method for providing a tamper evident article of furniture, the method comprising:

providing the article of furniture of claim 18;

covering the inner resilient support system of the article of furniture with the outer removable cover having the resealable closing system; and securing the tamper evident seal to provide a non-reusable seal covering at least the portion of the resealable closing system to inhibit opening of the resealable closing system and accessing the inner resilient inner support system.

29. The method of claim 28 further comprising using the article of furniture and viewing the tamper evident seal to determine whether at least one of the resealable closing system and inner resilient support system has been compromised.

30. The method of claim 28 wherein the securing the tamper evident seal comprises sealing the tamper evident seal over the resealable closing system.

31. A method for providing a tamper evident mattress or a mattress foundation, the method comprising:

providing the mattress or mattress foundation of claim 1;

covering the inner resilient support system of the mattress or mattress foundation with the outer removable cover having the resealable closing system; and securing the tamper evident seal to provide a non-reusable seal covering at least the portion of the resealable closing system to inhibit opening of the resealable closing system and accessing the inner resilient inner support system.

32. The method of claim 31 further comprising using the mattress or mattress foundation and viewing the tamper evident seal to determine whether at least one of the resealable closing system and inner resilient support system has been compromised.

33. The method of claim 31 wherein the securing the tamper evident seal comprises sealing the tamper evident seal over the resealable closing system.

* * * * *